US005130008A

United States Patent [19]

Cabaraux et al.

[11] Patent Number: 5,130,008

[45] Date of Patent: Jul. 14, 1992

[54] FRAME UNIT FOR AN ELECTROLYSER OF THE FILTER-PRESS TYPE AND MONOPOLAR ELECTROLYSER OF THE FILTER-PRESS TYPE

[75] Inventors: Emile Cabaraux; Eric Paulus, both of Brussels, Belgium

[73] Assignee: Solvay & Cie S.A., Brussels, Belgium

[21] Appl. No.: 564,883

[22] Filed: Aug. 9, 1990

[30] Foreign Application Priority Data

Aug. 11, 1989 [BE] Belgium ..... 08900867

[51] Int. Cl.[5] ..... C25B 11/03

[52] U.S. Cl. ..... 204/283; 204/257; 204/253; 204/252

[58] Field of Search ..... 204/254, 252, 283, 257, 204/253

[56] References Cited

U.S. PATENT DOCUMENTS 4,654,136 3/1987 Dang et al. ..... 204/254

*Primary Examiner*—John Niebling
*Assistant Examiner*—Kishor Mayekar
*Attorney, Agent, or Firm*—Robert E. Burns; Emmanuel J. Lobato

[57] ABSTRACT

Frame unit for an electrolyser of the filter-press type, comprising a vertical frame (1) defining an electrolysis chamber (13), an electrode in the electrolysis chamber, comprising a pair of vertical metal sheets (6) arranged facing each other, horizontal or oblique metal rails (7) arranged between the sheets (6), and U-shaped or V-shaped vertical metal beams (8) inserted between the rails and the sheets, the beams (8) being arranged in pairs, symmetrically on either side of the rails (7), and being connected to each other by vertical plates (11) which join the rails (7) so as to form vertical ducts (12) in the chamber 13.

12 Claims, 8 Drawing Sheets

FRAME UNIT FOR AN ELECTROLYSER OF THE FILTER-PRESS TYPE AND MONOPOLAR ELECTROLYSER OF THE FILTER-PRESS TYPE

The invention relates to electrolysers of the filter-press type for the electrolytic production of a gas and to frame units forming part of the structure of these electrolysers.

Electrolysers of the filter-press type are generally made up of a stack of vertical frame units which alternately define anode and cathode electrolysis chambers in which electrodes are arranged vertically. Membranes with selective permeability or diaphragms which are permeable to the electrolytes can be inserted between the frame units, to separate the electrolysis chambers.

The invention relates chiefly to frame units forming part of the structure of electrolysers of this type, each of these frame units comprising a vertical frame defining an electrolysis chamber; the latter contains an electrode made up of a pair of perforated vertical metal sheets facing each other; horizontal metal rails are inserted between the sheets and fastened to the latter by suitable connecting members. In frame units of this type the metal rails and the connecting member are used to support the sheets of the electrode in the electrolysis chamber and play a part in connecting them to a source of current. They must be designed to allow a vertical circulation of the electrolyte and of the electrolysis products between the sheets of the electrode. For this purpose it has been proposed to give the rails a cross-section which is smaller than the distance separating the sheets and to employ, for the connecting members, vertical bars inserted between the horizontal rails and the sheets of the electrode. The vertical bars can have very diverse profiles (DE-A-2,821,984, JP-A-58-123,885). In document JP-A-58-123,885 it is proposed to employ metal strips bent into the shape of a gutter for the vertical bars. In these known frame units the horizontal rails and the vertical bars form a lattice assembly in the electrolysis chamber, which is detrimental to a standardization of the electrolysis conditions. This disadvantage is specially noticeable in the case where a gas is generated on the electrode during the electrolysis, since the lattice assembly forms an obstacle to a circulation of the gas and of the electrolyte in the electrolysis chamber.

The invention overcomes this disadvantage of the known frame units described above by providing a frame unit of a new design which facilitates the natural circulation of the gas and of the electrolyte during the electrolysis and which standardizes the conditions of electrolysis within the electrolysis chamber.

Consequently, the invention relates to a frame unit for an electrolyser of the filter-press type, the said frame unit comprising:

- a vertical frame defining an electrolysis chamber,
- an electrode in the electrolysis chamber, comprising a pair of perforated vertical metal sheets arranged facing each other, and
- a current lead to the electrode, the said current lead comprising horizontal or oblique metal rails arranged between the sheets and members for connecting the rails to the sheets, the connecting members comprising, in accordance with the invention, pairs of U-shaped or V-shaped vertical beams, arranged symmetrically on either side of the rails and connected to each other by vertical plates joining the rails so as to form vertical ducts in the electrolysis chamber.

In the frame unit according to the invention the frame can have any profile compatible with the structure of an electrolyser of the filter-press type. It can equally well have a circular or polygonal profile, for example a square, trapezoidal or rectangular one. It must be made of a material which stands up chemically to the electrolysis conditions. It may be made, for example of titanium or of nickel, according to whether it is intended to form an anode chamber or a cathode chamber in an electrolyser for the electrolysis of aqueous sodium chloride solutions.

The metal sheets making up the electrode can be, for example, metal sheets pierced with openings, expanded metal sheets or trellises.

The choice of the sheet material depends on the destination of the electrode. For example, in the case where the electrode is intended to operate as a cathode for the production of hydrogen in a cell for the electrolysis of water or of aqueous solutions, the sheets may be made of iron, steel, nickel or any other conductive material which is active for the electrolytic production of hydrogen, such as, for example, those described in patents EP-A-8,476, FR-A-2,460,343, EP-A-113,931 and EP-A-131,978 (Solvay & Cie). In the case where the electrode is intended to operate as an anode for the generation of chlorine in a cell for the electrolysis of an aqueous sodium chloride solution, the sheets may advantageously be made of a film-forming conductive material selected from titanium, tantalum, niobium, zirconium, tungsten and alloys of these metals, carrying an active conductive coating made of a material chosen from platinum, ruthenium, rhodium, palladium, osmium, iridium and alloys and compounds of these materials, especially their oxides. Electrodes which are especially suitable for the production of chlorine by the electrolysis of aqueous sodium chloride solutions are those in which the material of the active coating comprises a mixture of ruthenium oxide and of titanium oxide or one of the compounds described in patents BE-A-769,677, BE-A-769,678, BE-A-769,679, BE-A-776,709 and BE-A-785,605 (Solvay & Cie).

The metal rails have a thickness which is smaller than the distance separating the two sheets making up the electrode. They are arranged horizontally or obliquely between the sheets to which they are connected by the vertical metal U-beams.

The expression "U- or V-beams" is intended to denote beams of a convex cross-section exhibiting the configuration of a gutter. In accordance with the invention the beams may therefore have a semicircular, semioval or semipolygonal cross-section.

The rails and the beams interact to convey the electrical current between a source of current and the sheets of the electrode during an electrolysis operation. In an alternative form they can also interact to support the sheets of the electrode in the frame. Furthermore, their convex cross-section endows the beams with good flexural strength, so that they also serve as stiffeners for the sheets of the electrode. The rails and the beams must be made of an electrically conductive material capable of withstanding the chemical environment during the electrolysis. Composite rails are advantageously employed, comprising a core made of a metal or alloy which is a good conductor of electricity (for example of copper or of aluminium) in a titanium or nickel sheath. Such composite rails can, for example, be obtained by a metallurgical combined spinning operation. The vertical beams may consist of metal strips, for example of titanium or of nickel, folded to give them the required U- or V-profile defined above. The vertical plates may be made of any materials capable of withstanding stresses of a mechanical, thermal and chemical nature which normally prevail in the electrolysers. They can be made of metal or of a polymeric material.

The U- or V-beams are arranged symmetrically, in pairs, on either side of the rails. The two beams of each pair are connected together by vertical plates joining the rails so as to form a vertical duct. The latter opens into the electrolysis chamber at its two ends, preferably in the vicinity of the frame. In the frame unit according to the invention the space defined between the two sheets of the electrode is thus partitioned by ducts so that, during the electrolysis, the electrolyte is subjected to an upward movement between the ducts under the action of the gas generated at the electrode and to a downward movement in these ducts. This results in an internal circulation of the electrolyte inside the electrolysis chamber, which promotes a standardization of the conditions of electrolysis. It is therefore necessary, in accordance with the invention, that the inner space of the ducts should not be the site of a gas release. To this end, the inner space of the ducts must be insulated from the electrodes; in addition, the faces of the beams and of the plates which are directed towards the interior of the ducts must be made of a material which does not take part in the electrolysis reaction when the electrolyser is operating.

In a particular embodiment of the frame unit according to the invention the frame comprises two vertical uprights connected by two horizontal lengthwise members, and the two lengthwise members are designed to form two internal channels which are pierced by openings on their corresponding walls which face each other in the electrolysis chamber; one of the channels is connected to an electrolyte entry conduit and the other channel is connected to a conduit for removing the products of the electrolysis. In this embodiment of the frame unit according to the invention the channels of the lengthwise members are used to distribute the electrolyte into the electrolysis chamber and to remove therefrom the products resulting from the electrolysis. It is preferably the channel of the lower lengthwise member which is connected to the electrolyte entry conduit, the channel of the upper lengthwise member being connected to the conduit for removing the products of the electrolysis.

The frame unit according to the invention is intended to form an integral part of an electrolyser of the monopolar type.

The invention consequently also relates to an electrolyser of the monopolar, filter-press type comprising a stack of frame units in accordance with the invention, alternately defining anode and cathode electrolysis chambers. The invention applies very especially to electrolysers of this type, in which the electrolysis chambers are separated by separators which are permeable to ions. The separators are sheets inserted between the successive frame units of the stack and made of a material through which an ion current can pass when the electrolyser is in operation. They may be diaphragms which are permeable to aqueous electrolytes or selectively permeable membranes, the difference being of no consequence.

Examples of diaphragms which can be employed in the electrolysers according to the invention are asbestos diaphragms such as those described in U.S. Pat. No. 1,855,497 (Stuart) and in Patents FR-A-2,400,569, EP-A-1,644 and EP-A-18,034 (Solvay & Cie) and diaphragms made of organic polymers, such as those described in Patents FR-A-2,170,247 (Imperial Chemical Industries PLC) and in Patents EP-A-7,674 and EP-A-37,140 (Solvay & Cie).

Selectively permeable membranes means thin, nonporous membranes comprising an ion exchange substance. The choice of the material forming the membranes and the ion exchange substance will depend on the nature of the electrolytes subjected to electrolysis and on the products which it is intended to obtain. As a general rule the material of the membranes is chosen from those which are capable of withstanding the thermal and chemical conditions which normally prevail in the electrolyser during the electrolysis, the ion exchange substance being chosen from anion exchange substances or cation exchange substances, depending on the electrolysis operations for which the electrolyser is intended.

For example, in the case of electrolysers intended for the electrolysis of aqueous sodium chloride solutions for the production of chlorine, hydrogen and aqueous sodium hydroxide solutions, suitable membranes are cation membranes made of fluorinated, preferably perfluorinated, polymer containing cationic functional groups derived from sulphonic acids, from carboxylic acids or from phosphonic acids or from mixtures of such functional groups. Examples of membranes of this type are those described in Patents GB-A-1,497,748 and GB-A-1,497,749 (Asahi Kasei Kogyo K. K.,) GB-A-1,518,387, GB-A-1,522,877 and U.S. Pat. No. 4,126,588 (Asahi Glass Company Ltd) and GB-A-1,4,02,920 (Diamond Shamrock Corp.). Membranes which are particularly suited for this application of the cell according to the invention are those known by the names "Nafion" (Du Pont de Nemours & Co) and "Flemion" (Asahi Glass Company Ltd).

The electrolysers according to the invention find an especially advantageous application for the production of chlorine and of aqueous sodiumhhydroxide solutions by electrolysis of aqueous sodium chloride solutions.

Special features and details of the invention will emerge from the description which follows, with reference to the attached drawings.

FIG. 8 is a vertical section of an electrolyser made up of a stack of vertical frame units.

In these figures, the same reference numbers denote identical components.

Figure 1:
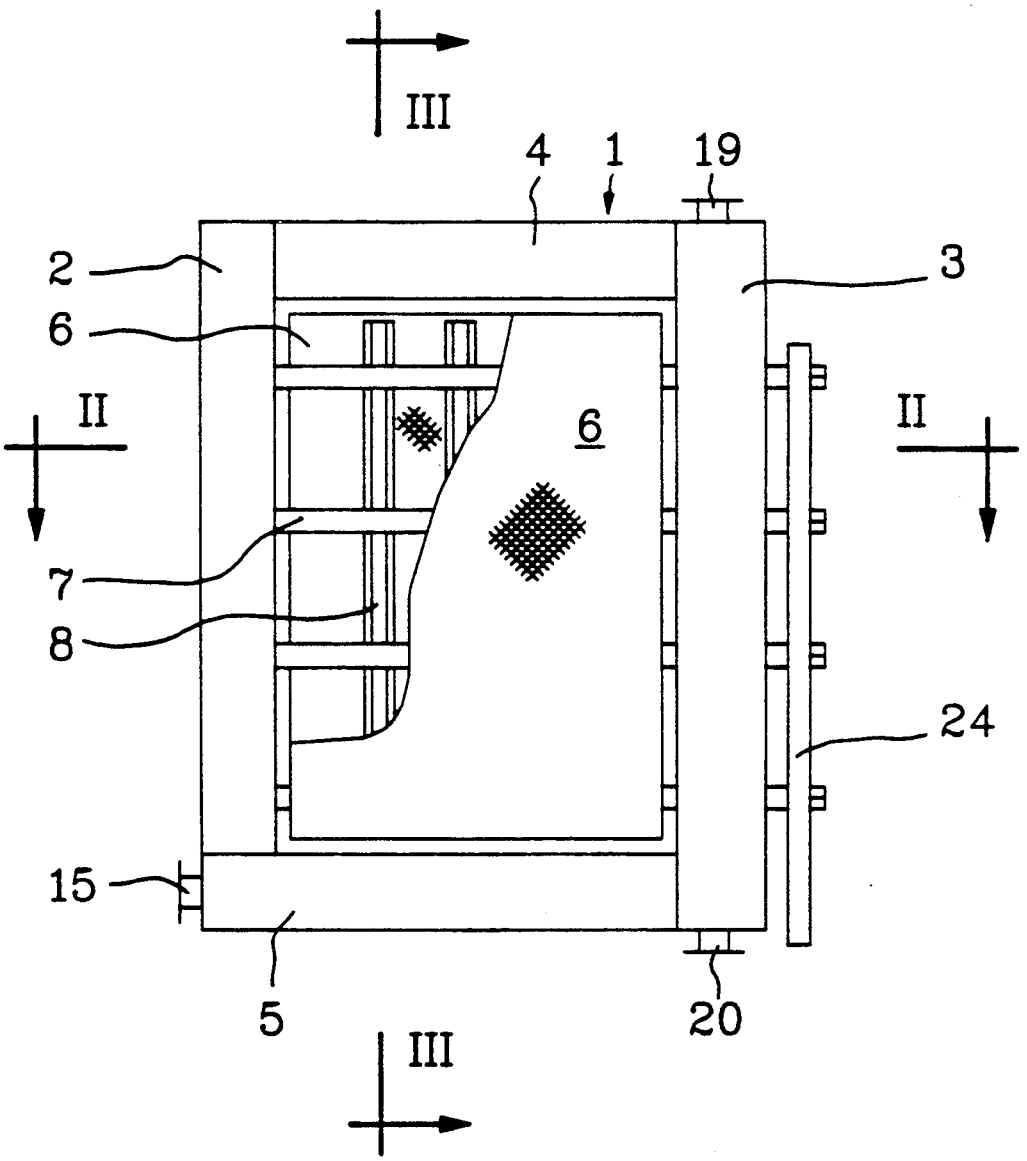
FIG. 1 is an elevation view, with partial cutaway, of a particular embodiment of the frame unit according to the invention.

In the description which follows, the invention is applied specifically to monopolar electrolysers of the filter-press type with cation membranes, for the production of chlorine, hydrogen and aqueous sodium hydroxide solutions by electrolysis of aqueous sodium chloride solutions.

The frame unit in accordance with the invention, shown in FIGS. 1 to 5, is intended to form an anode chamber of the electrolyser. It comprises a vertical chamber of the electrolyser. It comprises a vertical frame denoted generally by the reference number 1, exhibiting an approximately square cross-section. The frame 1 comprises two vertical uprights 2 and 3 made of titanium, welded to two lengthwise members 4 and 5, also made of titanium.

The space 13 circumscribed by the frame 1 forms an anode electrolysis chamber. This contains an anode made up of a pair of vertical sheets 6 of expanded metal, which are arranged on either side of a number of horizontal metal rails 7. The sheets 6 are welded to vertical beams 8 which are furthermore welded to the horizontal rails 7. The rails 7 are welded to the uprights 2 and 3 of the frame, through which they pass. They are fastened together to a busbar 24, intended to be coupled to a source of current. The rails 7 and the beams 8 thus contribute to the coupling of tn sheets 6 to the source of current and to the support of these sheets inside the frame 1.

Figure 2:
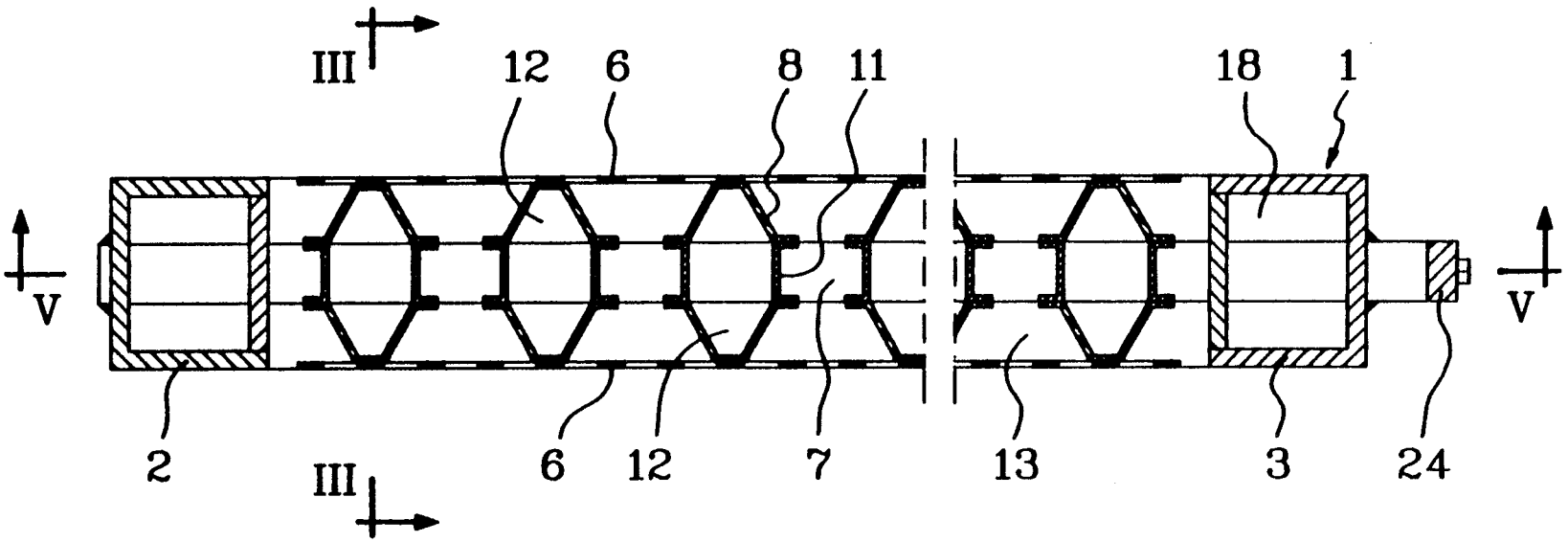
FIG. 2 is a horizontal section along the plane II—II of FIGS. 1 and 3.
Figure 3:
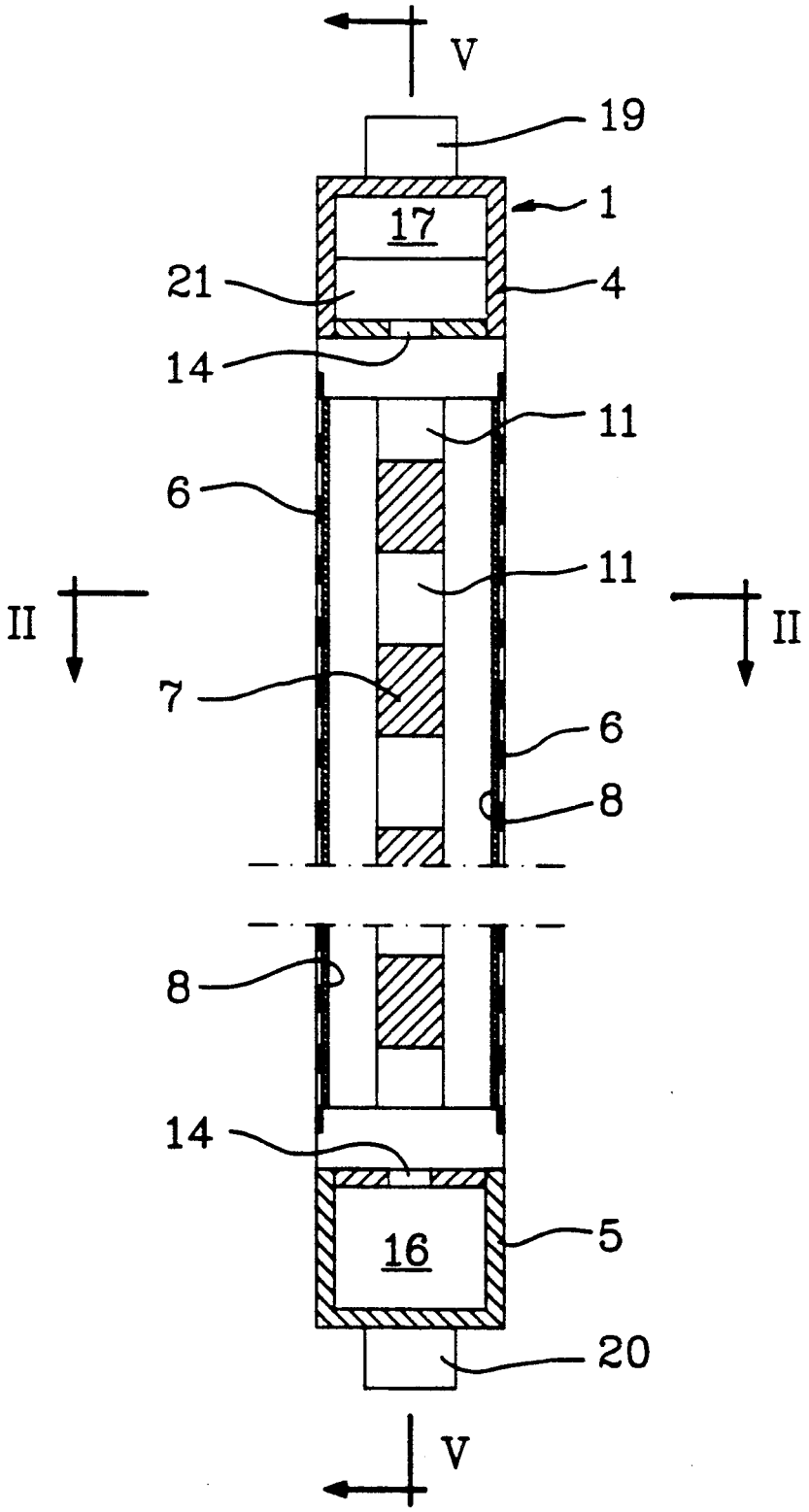
FIG. 3 is a vertical section along the plane III—III of FIGS. 1 and 2.
Figure 4:
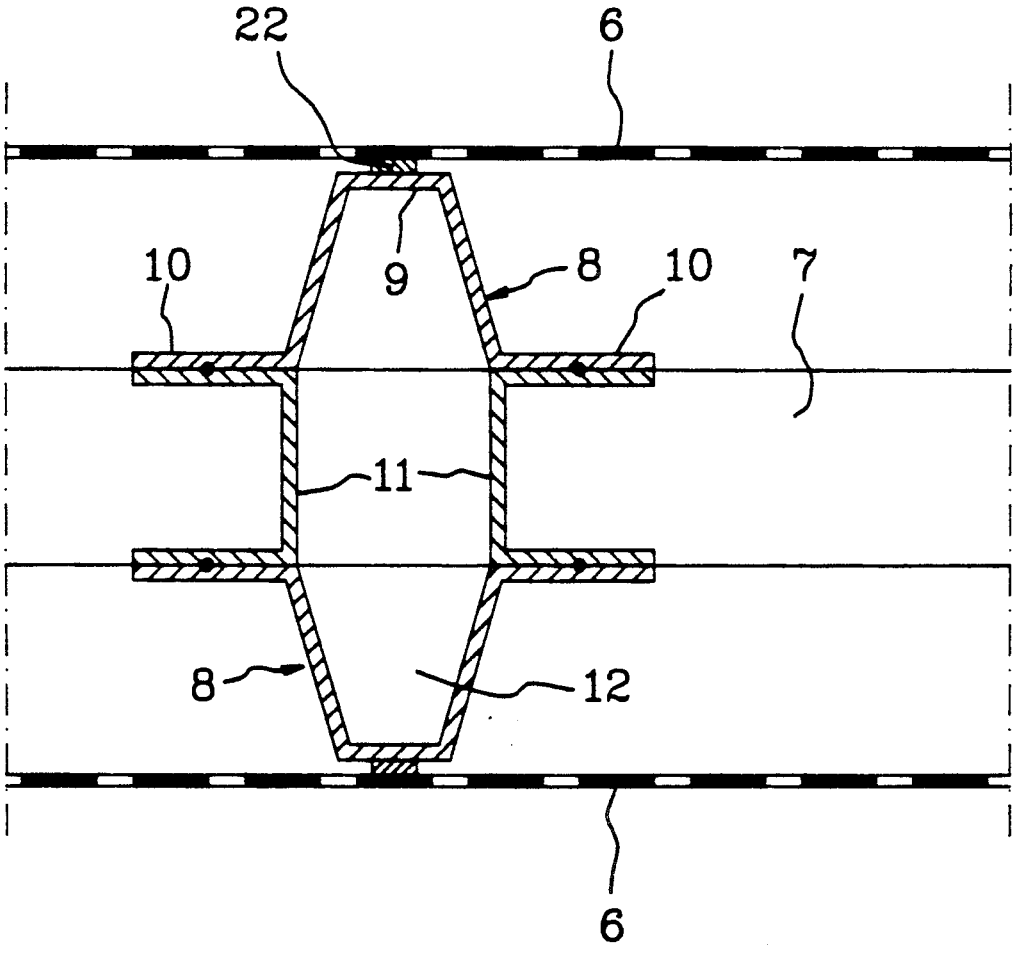
FIG. 4 is a large scale view of a detail of FIG. 2 with a modification.
Figure 5:
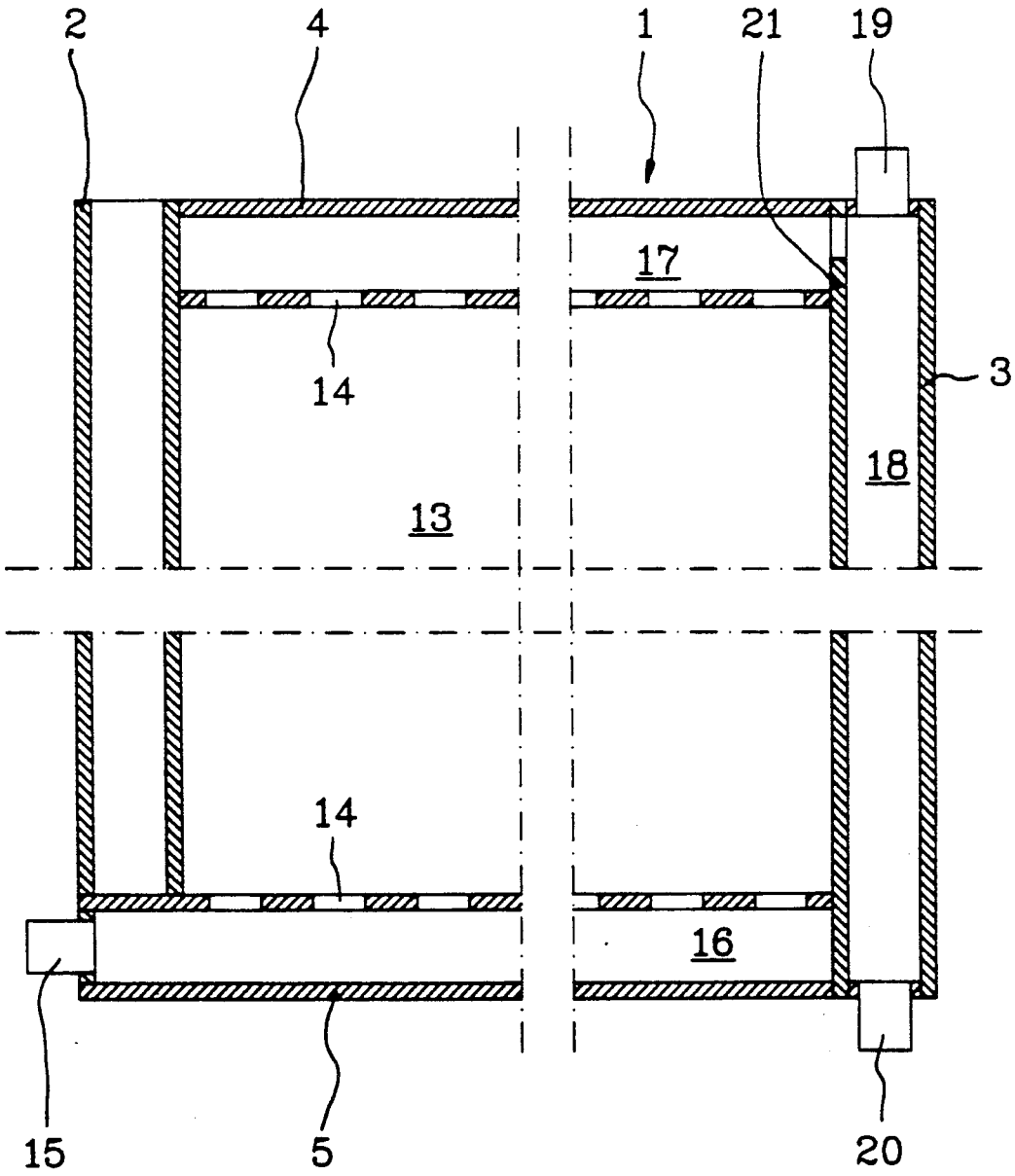
FIG. 5 is a view of the frame of the frame unit of FIGS. 1 to 3 in section along the median vertical plane V—V of FIGS. 2 and 3.

The sheets 6 are titanium sheets carrying an electrically conductive coating with a low overvoltage for the electrochemical oxidation of chloride ions. Such coatings are well known in electrolysis technology. The rails 7 comprise a copper core jacketed in a titanium cladding. Each of the vertical beams 8, which can be seen better in FIGS. 2, 3 and 4, is made up of a vertical titanium strip folded into a U or Ω shape so as to have the shape of a gutter. They are fastened to the sheets 6 along the axial median part 9 of the U and to the rails 7 along their marginal strips 10 (FIG. 4).

The vertical beams 8 are arranged symmetrically, in pairs, on either side of the rails 7. The two beams 8 of each pair are connected by vertical plates 11 extending between successive rails 7 so as to form a vertical duct 12 between the two sheets 6. The vertical plates 11 are sheets of titanium welded to the marginal strips 10 of the rails 8 (FIG. 4). Each duct 12 is thus insulated from the sheets 6 making up the anode, so that it is not the site of a formation of chlorine during the electrolysis of an aqueous sodium chloride solution in contact with the sheets 6. The upper and lower ends of the beams 8 are held at a distance from the lengthwise members 4 and 5 of the frame 1, so that the ducts 12 open into the electrolysis chamber at their two ends.

The lengthwise members 5 and 4 and the upright 3 of the frame 1 are designed to form internal channels of a square or rectangular section which will be used respectively to introduce an aqueous sodium chloride solution into the electrolysis chamber 13 and to remove therefrom the products resulting from the electrolysis (chlorine and a dilute aqueous sodium chloride solution). To this end, the lengthwise members 4 and 5 are pierced by uniformly spaced openings 14 in their walls facing each other in the chamber 13. The lower lengthwise member 5 is fitted with a pipe 15 for allowing the aqueous sodium chloride solution which is to be electrolysed to enter its channel 16. The channel 17 defined in the upper lengthwise member 4 is used as a degassing chamber, to separate chlorine from the dilute aqueous sodium chloride solution leaving the electrolysis chamber 13. It opens into the channel 18 formed in the upright 3, fitted with a pipe 19 for removing the chlorine and a pipe 20 for removing the dilute sodium chloride solution. A weir 21 separating the channels 17 and 18 is used to keep a constant level solution in the channel 17.

When the frame unit shown in FIGS. 1 to 5 is being used in an electrolyser the electrolysis chamber 13 is filled with an aqueous sodium chloride solution up to the upper level of the weir 21. An aqueous sodium chloride solution is introduced continuously into the channel 16 via the pipe 15, enters the electrolysis chamber 13, passing through the openings 14 and is entrained upwards in the latter by the chlorine which is generated on the sheets 6 of the anode. In the chamber 13, the vertical ducts 12 are not the site of a chlorine release, so that the density of the solution present in it is higher than that of the emulsion in the remaining part of the chamber 13. An internal circulation of electrolyte is thus established in the chamber 13: the electrolyte entering the chamber via the channel 16 is entrained into an upward motion between the sheets 6, a proportion of it is removed with chlorine by the channel 17 and another proportion is recycled to the bottom of the chamber 13 through the ducts 12. The internal circulation of electrolyte in the chamber 13 promotes a better homogenization and, consequently, an optimum energy efficiency of the electrolysis operation.

In the channel 17 chlorine is separated from the aqueous sodium chloride solution and is removed by the pipe 19. The aqueous solution overflows the weir 21 and flows into the vertical channel 18, from where it is removed by the pipe 20.

In the preceding description of FIGS. 1 to 5 the invention has been applied to a frame unit of an anode chamber of the electrolyser. In the case of a frame unit intended for a cathode chamber of the electrolyser the uprights 2 and 3 and the lengthwise members 4 and 5 of the frame 1 are made of nickel, the sheets 6 form a cathode and are made of nickel (and may carry a conductive coating with a low overvoltage for the reduction of protons), the rails 7 are made of nickel or have a copper core jacketed with a nickel cladding and the beams 8 and the plates 11 are made of nickel.

In a modified embodiment of the frame unit, shown in FIG. 4, inserts 22 are placed between the sheets 6 and the median part 9 of each of the beams 8. These inserts 22 are made of an electrically conductive material and are welded to the sheets 6 and to the beams 8. They can equally be rods extending over the whole height of the beams 8, or uniformly spaced studs. Their function is to ensure a substantial separating distance between the sheets 6 and the beams 8, so as to allow electrolyte to flow between the sheets and the beams.

This embodiment of the frame unit according to the invention is intended especially for membrane electrolysers in which it is found necessary to ensure an efficient wetting of the membrane by the electrolyte present in the electrolysis chamber 13.

Figure 6:
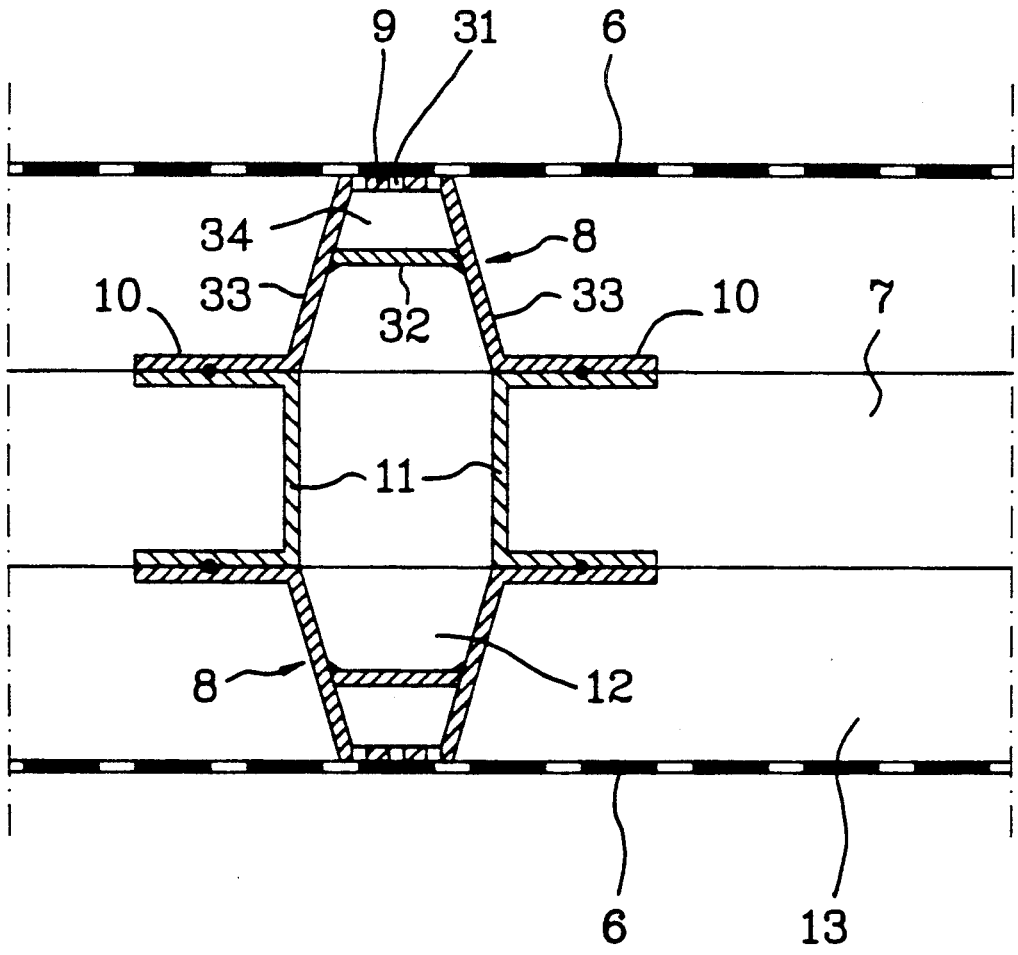
FIG. 6 is a large scale view of a modified embodiment of the detail of FIG. 2.

FIG. 6 shows another embodiment of the frame unit according to the invention, also designed for ensuring an efficient wetting of the membrane by the electrolyte. In this embodiment the median part 9 of the beams 8 is pierced by holes 31; a vertical partition 32 connecting the two wings 33 of the beam isolates the duct 12 from a vertical channel 34. The part of the wings 33 which is situated between the median part 9 and the partition 32 may be optionally perforated to facilitate the communication between the chamber 13 and the channel 34.

Figure 7:
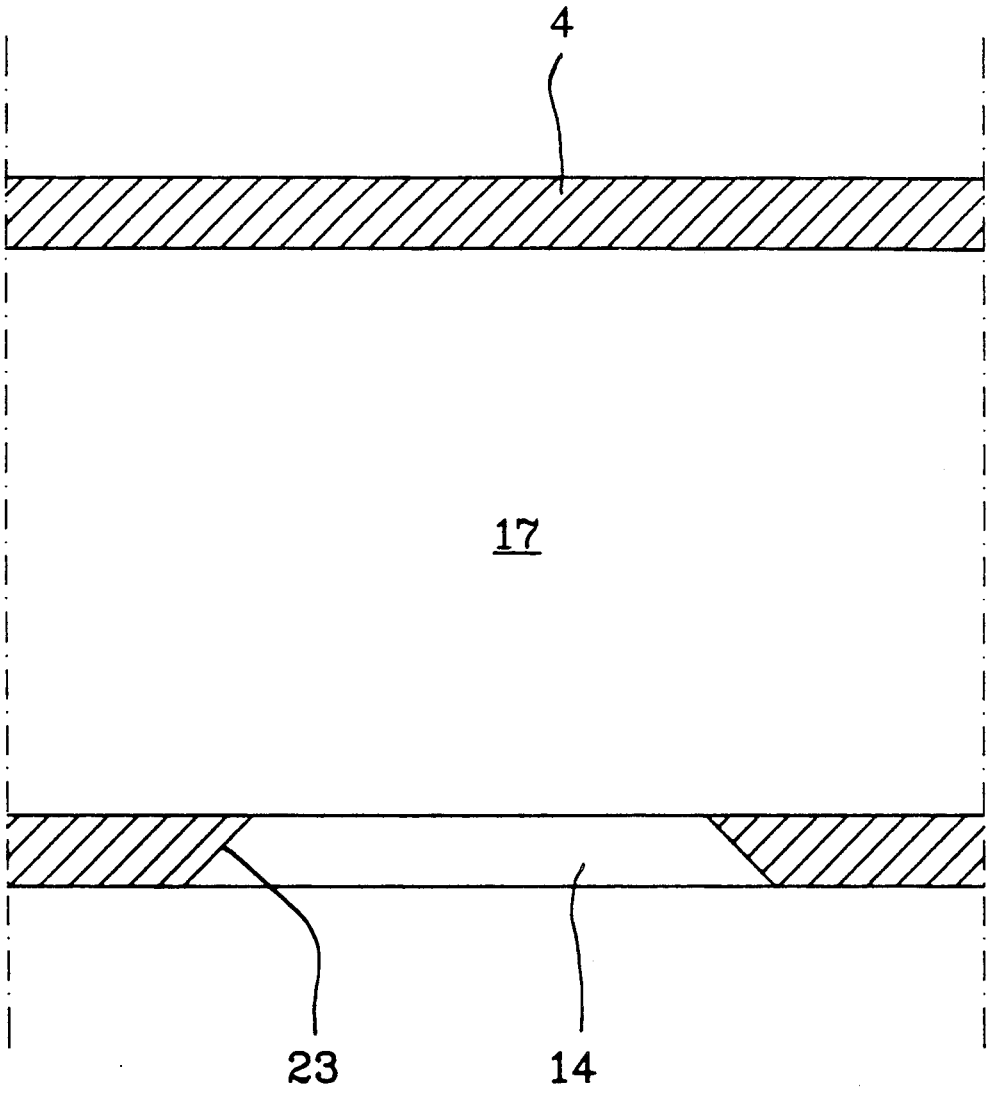
FIG. 7 is a large scale view of a detail of FIG. 6.

In an additional embodiment of the frame unit according to the invention, shown in FIG. 7, the openings 14 of the upper lengthwise member 4 of the frame unit 1 have their edge 23 chamfered in the direction in which the cross-section of the opening decreases from the bottom upwards. This embodiment of the invention accelerates the flow of gas from the chamber 13 towards the channel 17 during the electrolysis.

Figure 8:
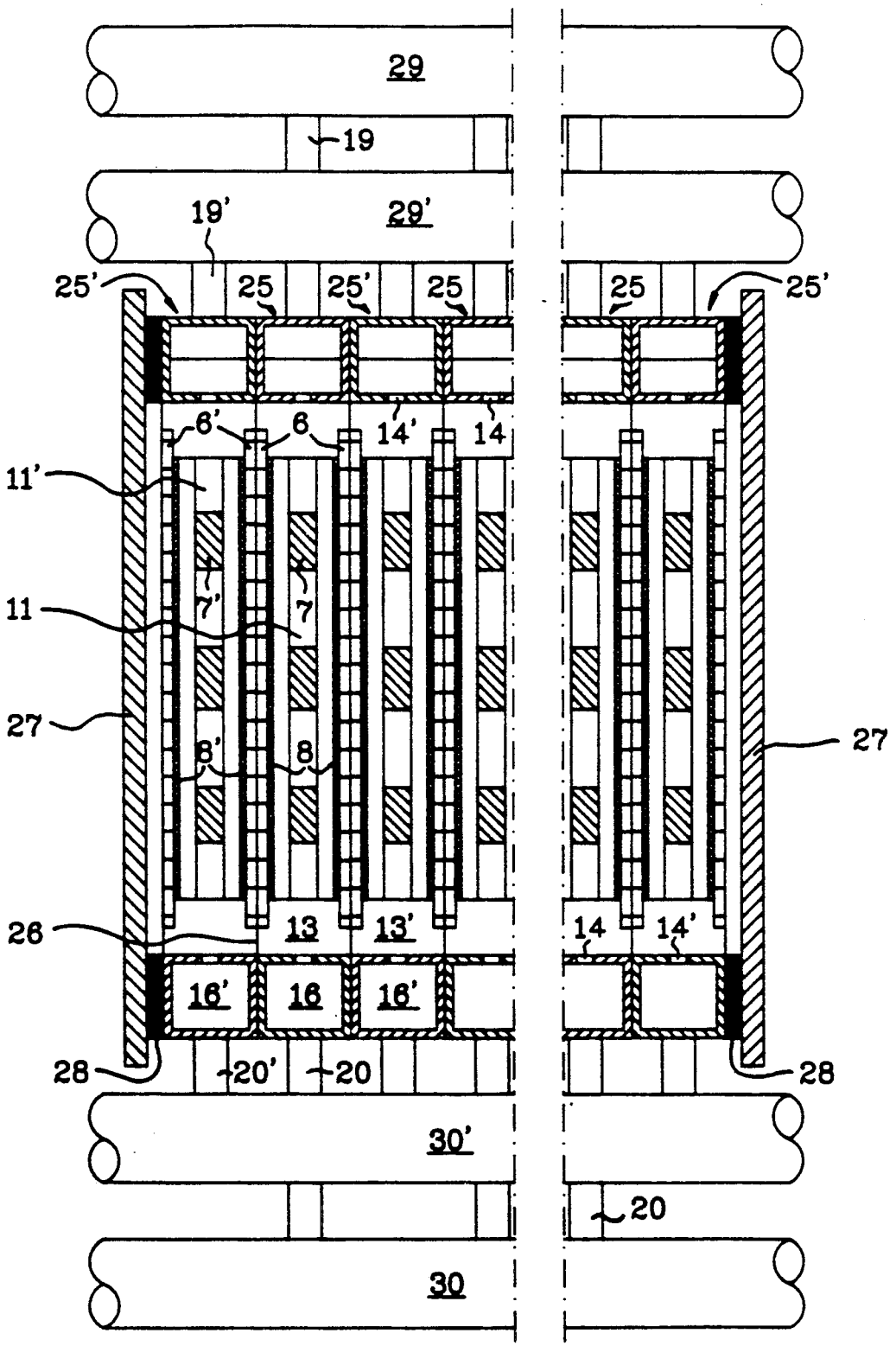
FIG. 8 shows, in a lengthwise vertical section, a particular embodiment of the electrolyser according to the invention.

The electrolyser shown in FIG. 8 is made up of a stack of vertical frame units, alternately anode 25 and cathode 25'. The anode frame units 25 are similar to those described above with reference to FIGS. 1 to 7. The cathode frame units 25' are similar to the anode frame units 25 in which the constituent members made of titanium have been replaced with similar members made of nickel. These nickel members of the frame units 25' bear the same reference numbers as their respective homologues of the frame units 25, but have been given a prime mark (′). The frame units 25 and 25' are separated by cationic membranes 26 which thus define alternately anode and cathode electrolysis chambers. The stack of the frame units 25 and 25' and of the membranes 26 is held between end flanges 27 which are connected by tie rods, not shown, with seals 28 ensuring the leakproofing. The vertical connecting rails 24 (FIG. 1) of the anode frame units 25 are coupled to a busbar connected to the positive terminal of a source of direct current, the connecting rails, the busbar and the source of current not being visible in FIG. 7. Similarly, the cathode frame units 25' are joined to a common busbar connected to the negative terminal of the source of direct current. Furthermore, the pipes 15 of the anode frame units 25 (FIGS. 1 and 5) open into a common manifold for allowing an aqueous sodium chloride solution to enter, this manifold and the pipes 15 no being visible in FIG. 7. By analogy, the corresponding pipes of the cathode frame units 25' open into a common manifold for allowing water or a dilute aqueous sodium hydroxide solution to enter. The pipes 19 and 20 of the anode frame units 25 open into two general manifolds 29 and 30 respectively, the manifold 29 being used for removing the chlorine produced in the anode chambers 13 and the manifold 30 being used for removing the dilute sodium chloride solution. Similarly, the pipes 19' and 20' of the cathode frame units 25' open into two general manifolds 29' and 30' respectively, the manifold 29' being used to remove the hydrogen produced in the cathode chambers 13' and the manifold 30, being used to remove a concentrated aqueous sodium hydroxide solution.

While the electrolyser is in operation the hydrostatic pressure prevailing in the electrolysis chambers 13 of the anode frame units 25 is usually lower than that prevailing in the chambers 13' of the cathode frame units 25'. As a result the membranes 26 are pushed towards the sheets 6 of the anodes. Because of their convex cross-section, the vertical beams 8 resist efficiently a flexing of the sheets 6.

Conversely, in the case of an electrolyser operating with a positive hydrostatic pressure difference between the anode chambers 13 and the cathode chambers 13', the vertical beams 8' of the frame units 25' resist a flexing of the sheets 6' of the cathodes.

We claim:

1. A frame unit for an electrolyser of the filter-press type comprising:

a vertical frame comprising two spaced upright members connected by spaced upper and lower horizontal members defining an electrolysis chamber.

a plurality of horizontal metal rail spaced apart from one another and extending between said upright members of said frame, an electrode in said electrolysis chamber, said electrode comprising a pair of perforate vertical metal sheets disposed respectively on opposite sides of said horizontal metal rails and spaced from said rails, a plurality of vertical ducts each comprising a pair of gutter shaped sheet metal members disposed between said perforate metal sheets of said electrode and said horizontal metal rails, said gutter shaped members having median portions bonded to said perforate metal sheets of said electrode and edge portions bonded to said horizontal metal rails, and vertical plates connecting said gutter shaped members of a pair with one another between said horizontal metal rails, upper and lower ends of said vertical ducts being spaced from said upper and lower horizontal members of said frame to provide flow channels for downward flow of electrolyte in said electrolysis chamber, and means for connecting said horizontal metal rails with a source of electrical current.

2. A frame unit according to claim 1, in which faces of said gutter shaped members which are directed towards the interior of said ducts are of a material which does not take part in an electrolysis reaction.

3. A frame unit according to claim 1, in which median portions of said gutter shaped members are perforate and in which a vertical partition connecting opposite wings of each of said gutter shaped members isolates said vertical duct from a vertical channel extending along the median part of said gutter shaped member.

4. A frame unit according to claim 1, in which said upper and lower horizontal members of said frame form internal channels and in which walls of said channels facing said electrolysis chamber are perforate to provide communication between said channels and said electrolysis chamber.

5. A frame unit according to claim 4, in which said channel of said lower horizontal member is connected with a conduit for electrolyte to said electrolysis chamber and said channel of said upper horizontal member is connected to a conduit for removing electrolyte from said electrolysis chamber.

6. A frame unit according to claim 5, in which said conduit for removing electrolyte comprises an internal channel in one of said upright members of said frame.

7. A frame unit according to claim 4, further comprising at least one weir in said internal channel of said upper horizontal member of said frame.

8. A frame unit according to claim 1, in which said horizontal metal rails extend through one of said upright members of said frame and are connected with a busbar for connection to a source of electrical current.

9. A frame unit according to claim 1, further comprising inserts of electrically conducting material inserted between said median portions of said gutter shaped members and said perforate metal sheets of said electrode.

10. A frame unit according to claim 1, in which said horizontal rails comprise a copper core jacketed in a titanium cladding.

11. An electrolyser of the monopolar, filter press type, comprising a stack of frame units in accordance with any one of claims 1 to 10.

12. An electrolyser according to claim 1 in which selectively permeable membranes are interposed between adjacent ones of said frame units.

* * * * *